US006466174B2

(12) United States Patent
Haussler et al.

(10) Patent No.: US 6,466,174 B2
(45) Date of Patent: Oct. 15, 2002

(54) SURFACE MOUNT CHIP ANTENNA

(75) Inventors: Bradley Scott Haussler, Lincoln, NE (US); Michael Gregory Volkmer, Lincoln, NE (US); Mark Frederick Mayer, Lincoln, NE (US); Vladimir Stoiljkovic, Bucks (GB)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

(21) Appl. No.: 09/779,259

(22) Filed: Feb. 8, 2001

(65) Prior Publication Data

US 2002/0105467 A1 Aug. 8, 2002

(51) Int. Cl.[7] ..... H01Q 1/24
(52) U.S. Cl. ..... 343/702; 343/895; 343/873
(58) Field of Search ..... 343/702, 895, 343/872, 873, 700 MS; H01Q 1/24

(56) References Cited

U.S. PATENT DOCUMENTS 5,014,071 A * 5/1991 King ..... 343/788
6,288,680 B1 * 9/2001 Tsuru et al. ..... 343/702
6,297,777 B1 * 10/2001 Tsubaki et al. ..... 343/700 MS
6,320,545 B1 * 11/2001 Nagumo et al. ..... 343/700 MS

* cited by examiner

*Primary Examiner*—Hoanganh Le
(74) *Attorney, Agent, or Firm*—Thomte, Mazour & Niebergall; Dennis L. Thomte

(57) ABSTRACT

A surface mounted CHIP antenna is provided for a wireless communications device such as a wireless modem, cellular telephone, personal digital assistant, etc. The antenna is mounted directly to the circuit board of the unit and exhibits electrical performance equivalent to a traditional external antenna. The antenna includes a conductive trace which is embedded or encapsulated in a high temperature, non-conductive dielectric material. One end of the trace has a transceiver circuit lead protruding therefrom which is soldered to the feed of the transceiver circuit. One or more ground plane leads protrude from the other end of the body member and are soldered to the ground plane. The ground plane lead is electrically insulated from the trace.

11 Claims, 3 Drawing Sheets

SURFACE MOUNT CHIP ANTENNA

BACKGROUND OF THE INVENTION

1. Field of the Invention

The present invention relates to a surface mount CHIP antenna and more particularly to a surface mount CHIP antenna for a wireless communications device such as a wireless modem, cellular telephone, personal digital assistant, etc. More particularly, the antenna is mounted directly to the unit's circuit board and is not visible once the unit is assembled.

2. Description of the Related Art

Cellular telephones and other electronic and communications devices continue to be designed into smaller packages. Electronic technologies are being pushed to reduce the size of each component associated with the devices to enable the overall size of the package to become smaller, lighter in weight, and more user-friendly. One way to do this is to remove the external antenna and replace it with an internal antenna. An internal antenna may not have the same effective range as an external antenna, but works well with some of the new communications bands such as Bluetooth, PCS, etc.

SUMMARY OF THE INVENTION

A surface mount chip antenna for a wireless communications device such as a wireless modem, cellular telephone, personal digital assistant, etc., is described and includes a conductive trace having two or more leads that are soldered to the circuit board of the device. The main lead is soldered to the feed from the transceiver circuit and the other leads are soldered to the ground plane. The conductive trace forms a serpentine pattern parallel to the circuit board creating a radiating element. The radiating element feed point lead is not electrically connected to the ground plane leads. The conductive trace is encapsulated in a high temperature, non-conductive dielectric material that is able to withstand the high temperatures of reflow soldering.

It is therefore a principal object of the invention to provide a surface mount CHIP antenna for a wireless communications device such as a wireless modem, cellular telephone, personal digital assistant, etc.

Yet another object of the invention is to provide a surface mount CHIP antenna which exhibits electrical performance for gain and transmitted power which is equivalent to a traditional external antenna.

Yet another object of the invention is to provide a CHIP antenna which is cost-effective to manufacture.

Yet another object of the invention is to provide a CHIP antenna which is small and lightweight so as to be able to be fit into any existing device without the need for an external antenna.

Still another object of the invention is to provide an antenna that can be tuned to a resonant frequency by changing the length of the conductive trace, the dielectric used to encapsulate the trace, the width of the conductive trace, the separation distances between the parallel elements of the trace within the serpentine, the separation distance between the grounded contact and the active radiating element, and the length of the grounded contact in relation to the radiating element.

Yet another object of the invention is to provide an antenna wherein the above-listed objectives can be accomplished without altering the external physical dimensions of the antenna.

These and other objects will be apparent to those skilled in the art.

DESCRIPTION OF THE PREFERRED EMBODIMENT

Figure 1:
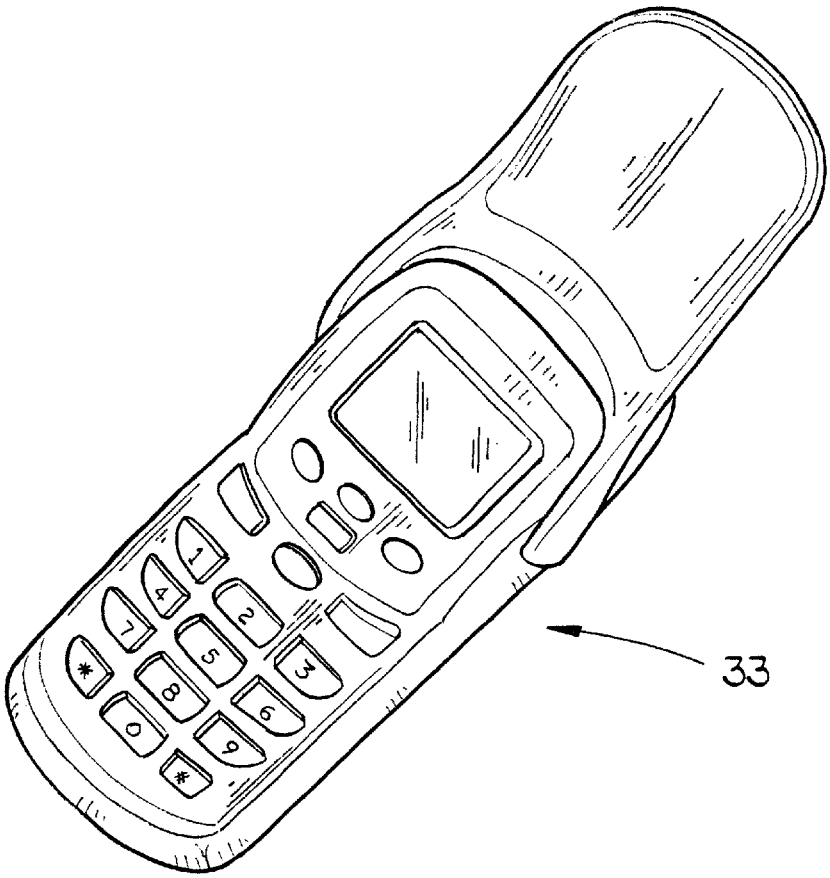
FIG. 1 is a perspective view of a cellular telephone.
Figure 2:
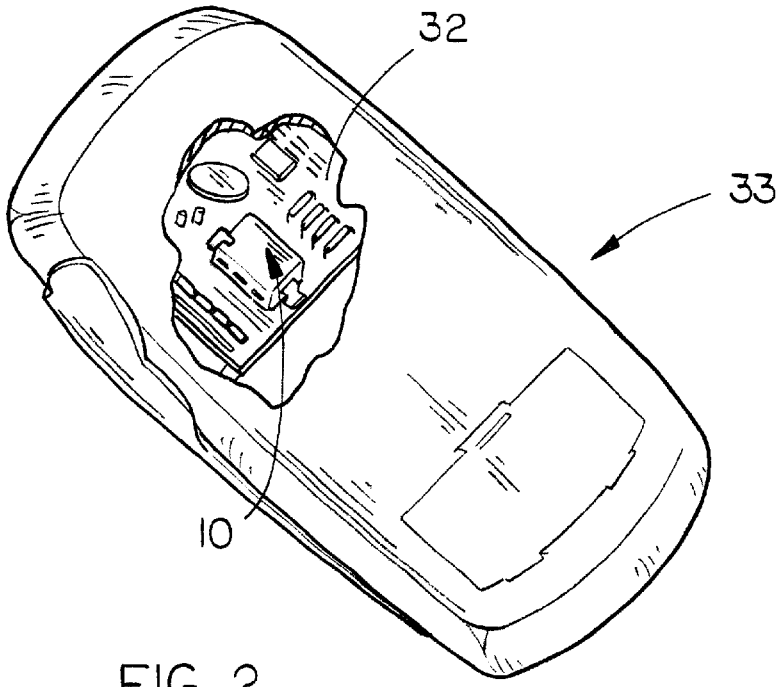
FIG. 2 is a rear perspective view of the telephone of FIG. 1 with a portion thereof cut away to illustrate the CHIP antenna of this invention mounted on the circuit board of the telephone.
Figure 3:
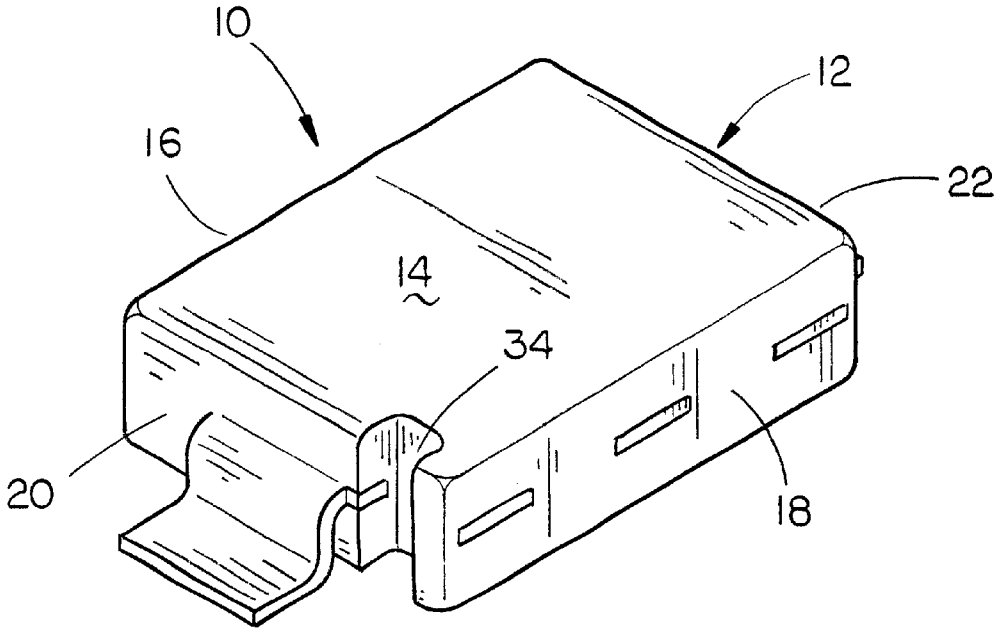
FIG. 3 is a perspective view of the antenna of this invention.
Figure 4:
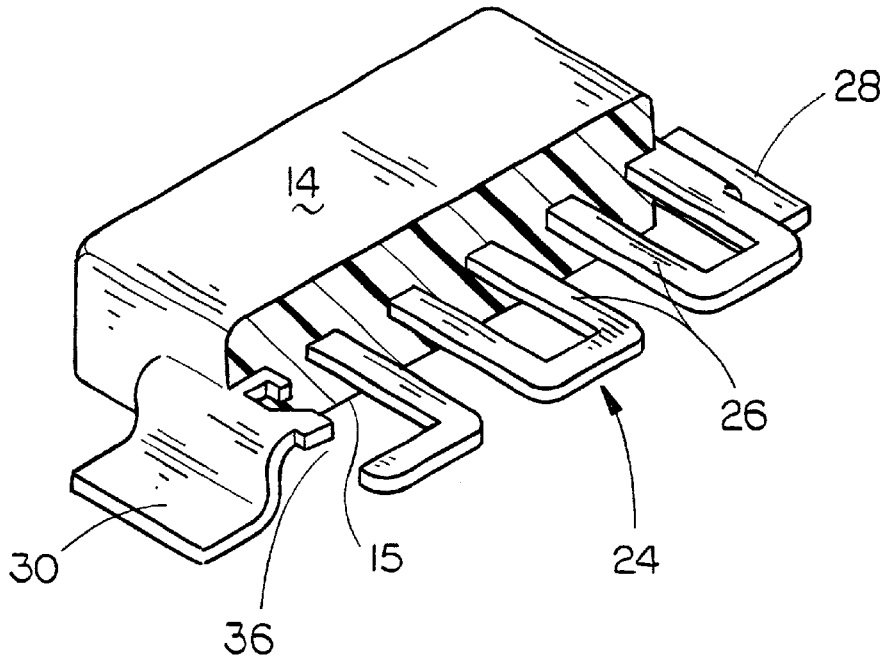
FIG. 4 is a view similar to FIG. 3 except that a portion of the antenna has been cut away to more fully illustrate the invention.

The surface mounted CHIP antenna of this invention is referred to generally by the reference numeral 10. Antenna 10 includes a body member 12 which, for purposes of description, will be referred to as including a top surface 14, bottom surface 15, opposite sides 16 and 18, and opposite ends 20 and 22. Body member 12 is comprised of a high temperature, non-conductive insulating material such as PEEK, LCP, or PES material.

The numeral 24 refers to a conductive trace preferably comprised of an end-plated steel material. Trace 24 preferably has a serpentine configuration having a plurality of parallel elements 26. Trace 24 includes a main or transceiver circuit lead 28 which is preferably integrally formed therewith and which protrudes from end 22 of the body member 12. A lead 28 is soldered to the feed from the transceiver circuit, as will be described hereinafter. One or more ground plane leads 30 have their inner ends embedded in the body member 12 and protrude therefrom to enable the lead 30 to be soldered to the ground plane.

The antenna 10 is mounted on the circuit board 32 of a wireless communications device 33 which in this case is illustrated as being a cellular telephone. The antenna 10 is mechanically and electrically connected to the circuit board 32 by soldering the main lead 28 to the feed from the transceiver circuit. The other leads 30 are soldered to the ground plane. The conductive trace 24 forms a serpentine pattern parallel to the circuit board 32 creating a radiating element. The radiating element feed point lead 28 is not electrically connected to the ground plane leads 30. The conductive trace 24 is encapsulated in the high temperature, non-conductive dielectric material of the body member 12 which is able to withstand the high temperatures of reflow soldering.

Figure 5:
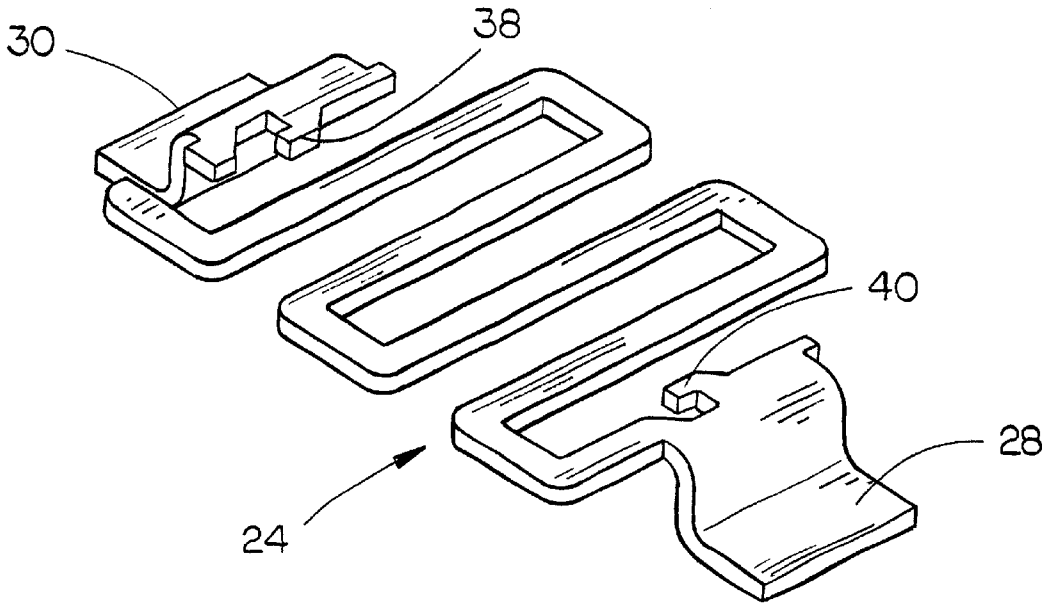
FIG. 5 is a perspective view of the conductive trace of the invention.
Figure 6:
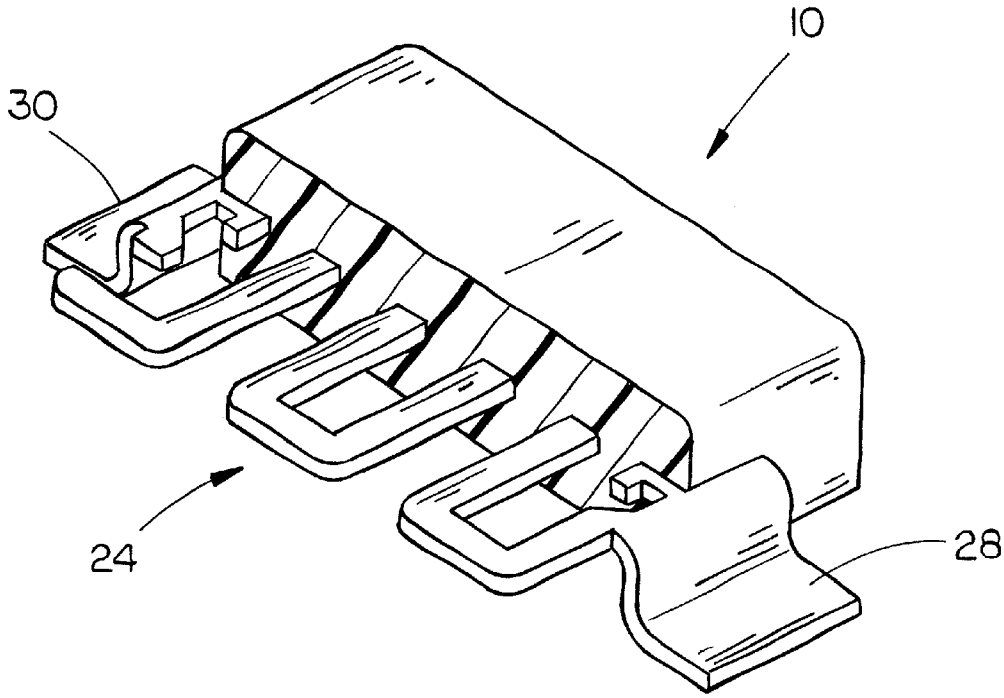
FIG. 6 is a view similar to FIG. 4 except that it illustrates the antenna from a different angle than that of FIG. 4.

For ease of manufacture, the conductive trace 24, lead 28 and the lead or leads 30 are normally initially formed in a one-piece manner to facilitate the embedding or encapsulating of the trace 24 and the leads 28 and 30 in the body member 12. Portions of the conductive trace 24 initially protrude outwardly from the body member 12 so as to provide convenient holding members during the encapsulation process. Once the conductive trace 24 and the leads 28 and 30 have been encapsulated in the body member 12, the holding members are severed from the conductive trace 24. The lead 30 is also separated from the conductive trace 24 by creating a notch 34 in the body member 12 to create a gap between the lead 30 and the conductive trace 24 which is generally referred to by the reference numeral 36 so that the conductive trace 24 is not electrically connected to the lead 30. As seen in FIG. 5, lead 30 is provided with one or more finger-like protrusions 38 which aid in preventing the separation of the lead 30 from the body member 12. Similarly, lead 28 is also provided with a finger-like protrusion 40 which also helps to stabilize the lead 28 in the body member 12.

The antenna of this invention can be tuned to a resonant frequency by changing the length of the conductive trace, the dielectric used to encapsulate the trace, the width of the conductive trace, the separation distances between the parallel elements of the trace within the serpentine, the separation distance between the grounded contact and the active radiating element, and the length of the grounded contact in relation the radiating element. Each of these objectives can be accomplished without altering the external physical dimensions of the antenna. Further, it has been found that the antenna can be tuned by adjusting the length and/or width of the trace (electrical connection means) which connects the ground plane lead 30 to the ground plane of the transceiver circuit of the wireless communication device.

The antenna of this invention is small and lightweight and is easily fitted into any existing device without the need for an external antenna. The antenna of this invention is cost-effective to manufacture and is easy to manufacture.

Thus it can be seen that the invention accomplishes at least all of its stated objectives.

We claim:

1. In combination with a wireless communication device including a transceiver circuit board positioned therein which has a surface, comprising:

a surface mounted chip antenna positioned on the surface of the transceiver circuit board and being electrically connected thereto;

said surface mounted chip antenna comprising: an elongated, electrically conductive trace having first and second ends; a body member comprised of an electrically non-conductive insulating material where said trace is at least partially embedded therein; and a ground plane lead partially embedded in said body member and extending therefrom for connection to the circuit board;

said ground lead and said trace being electrically insulated from one another.

2. The combination of claim 1 wherein said trace is generally parallel to the surface of the circuit board.

3. The combination of claim 1 wherein said trace includes multiple leads.

4. The combination of claim 1 wherein said trace is generally serpentine-shaped.

5. The combination of claim 1 wherein said body member has first and second ends and wherein said ground plane lead extends from said second end of said body member.

6. The combination of claim 5 wherein said first end of said trace protrudes from said first end of said body member to form a transceiver circuit lead which is electrically connected to the transceiver circuit board.

7. The combination of claim 6 wherein said second end of said trace is spaced from said ground lead.

8. The combination of claim 7 wherein said trace is generally serpentine-shaped.

9. The combination of claim 6 wherein said trace and said leads are comprised of tin-plated steel.

10. The combination of claim 1 wherein said antenna includes a ground plane lead and a transceiver lead which are electrically and mechanically connected to the transceiver circuit board.

11. The combination of claim 10 wherein electrical connection means connects said ground plane lead to the transceiver ground plane and wherein varying the length and/or width of said electrical connection means tunes said antenna.

* * * * *